US005152036A

United States Patent [19]

Oda et al.

[11] Patent Number: 5,152,036

[45] Date of Patent: Oct. 6, 1992

[54] LOCKABLE SLIDE FASTENER SLIDER

[75] Inventors: Kiyoshi Oda, Namerikawa; Susumu Ishii, Kurobe, both of Japan

[73] Assignee: Yoshida Kogyo K. K., Tokyo, Japan

[21] Appl. No.: 684,300

[22] Filed: Apr. 11, 1991

[30] Foreign Application Priority Data

Apr. 12, 1990 [JP] Japan ..... 2-97077

[51] Int. Cl.[5] ..... A44B 19/30

[52] U.S. Cl. ..... 24/424; 24/421

[58] Field of Search ..... 24/418, 420, 421, 424

[56] References Cited

U.S. PATENT DOCUMENTS 2,289,585 7/1942 Marinsky .
2,290,834 7/1942 Kohler .
2,397,638 4/1946 Rabinow .
2,487,386 11/1949 Scheuermann .
2,646,605 7/1953 Morin .
2,784,474 3/1957 Morin .
3,522,050 8/1970 Ambros et al. .
3,837,050 9/1974 Takamatsu .
3,919,746 11/1975 Fukuroi .
4,069,556 1/1978 Takahashi .
4,391,022 7/1983 Oda .
4,644,613 2/1987 Kedzierski ..... 24/424 X

FOREIGN PATENT DOCUMENTS 851471 1/1940 France .
2016076 9/1979 United Kingdom .

*Primary Examiner*—James R. Brittain
*Attorney, Agent, or Firm*—Hill, Van Santen, Steadman & Simpson

[57] ABSTRACT

A lockable slide fastener slider includes an upper wing and a lower wing defining therebetween a guide channel for the passage of fastener coupling elements, a pull tab pivotably mounted on the upper wing and a locking member having a locking prong movable into and away from the guide channel. A resilient biasing arrangement is provided in operative relation to the pull tab for urging the latter to lie substantially flat against the upper wing.

2 Claims, 6 Drawing Sheets

LOCKABLE SLIDE FASTENER SLIDER

BACKGROUND OF THE INVENTION

1. Field of the Invention

This invention relates to a lockable slider manipulated to open and close a slide fastener.

2. Prior Art

There have been proposed numerous slide fastener sliders having means locking the slider against unintentional displacement. One such prior locking slider is disclosed in U.S. Pat. No. 3,522,638 in which a locking pawl having a tooth is brought into and out of engagement with some of the coupling elements of the fastener in a slider channel by moving a handle flap (pull tab) pivotally in one or the other direction with its cam portion borne against the upper surface of the flap. A compression spring is adapted to normally hold the flap in horizontal flat position. A difficulty of this prior device is that if for some reason the tooth of the locking pawl fails to engage in the space between adjacent coupling elements as required but instead rides over the upper surfaces of the coupling elements, the locking pawl tends to somewhat press the spring so that the resilient force of the spring is not transmitted to the handle flap, leaving the latter free to wobble itself or hook on the garment or some other objects, resulting in damage to the handle flap or the hooked objects.

SUMMARY OF THE INVENTION

With the foregoing difficulties of the prior art in view, the present invention seeks to provide a lockable slide fastener slider incorporating a locking means which will ensure a firm lock of the slider in any longitudinal position of the slide fastener whether it be on a coupling element, a top end stop, a bottom end stop, or an end separator and which will further ensure retention of a pull tab in flipped flat position relative to the slider body when the slider is locked.

The above and other advantages and features of the invention will become manifest to one skilled in the art from reading the following detailed description with reference to the accompanying drawings. Like reference numerals refer to like or corresponding parts throughout the several views.

According to the invention, there is provided a slide fastener slider which comprises: a slider body including an upper wing and a lower wing joined at one of their respective ends by a neck so as to define therebetween a guide channel for the passage of a pair of rows of coupling elements; a pull tab pivotably connected through its pintle to the upper wing and having a cam means; a locking member pivotably supported on the slider body and including a locking prong movable into and away from the guide channel; a first resilient means urging the pull tab to flip down against the upper wing; and a second resilient means operatively associated with the pintle and adapted to urge the pull tab to lie substantially flat against the upper wing in compensation for the lack of resilient forces of the first resilient means.

DETAILED DESCRIPTION OF THE INVENTION

Figure 1:
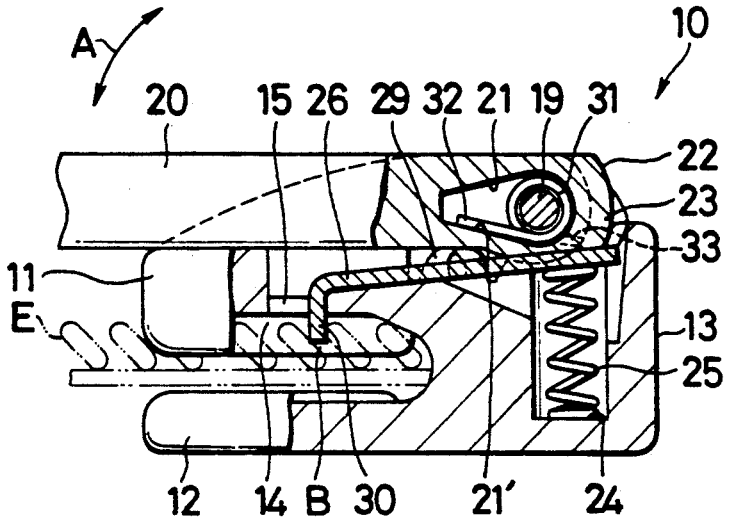
FIG. 1 is a side elevational, partly sectional, view on enlarged scale of a slider constructed in accordance with one or first embodiment of the present invention.
Figure 2:
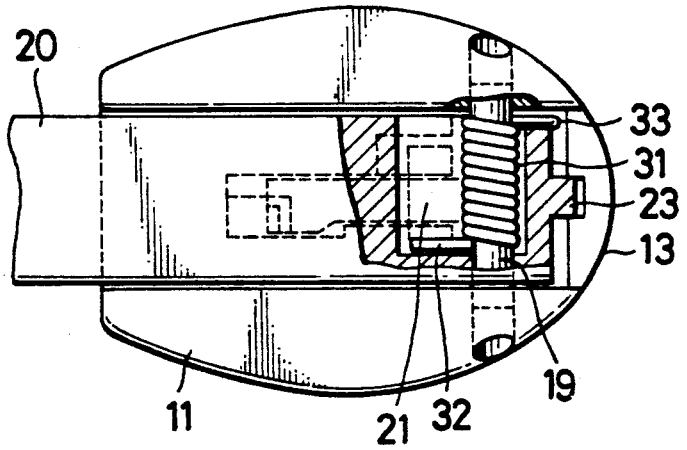
FIG. 2 is a partly sectional, plan view of the same.

Referring to the drawings and firstly FIGS. 1–5 inclusive, there is shown a lockable slider 10 provided in accordance with a first preferred embodiment of the invention. The slider 10 comprises a slider body including an upper wing member 11 and a lower wing member 12 joined at one of their respective ends by a wedge-shaped neck 13 at a front end of the slider body so as to define therebetween a substantially Y-shaped guide channel 14 for the passage of a pair of rows of coupling elements E on respective stringer tapes T as is well known. The upper wing 11 has an aperture 15 communicating with the guide channel 14 for allowing the passage therethrough of a locking prong later described into and out of the channel 14 to engage and disengage the coupling elements E.

Figure 5:
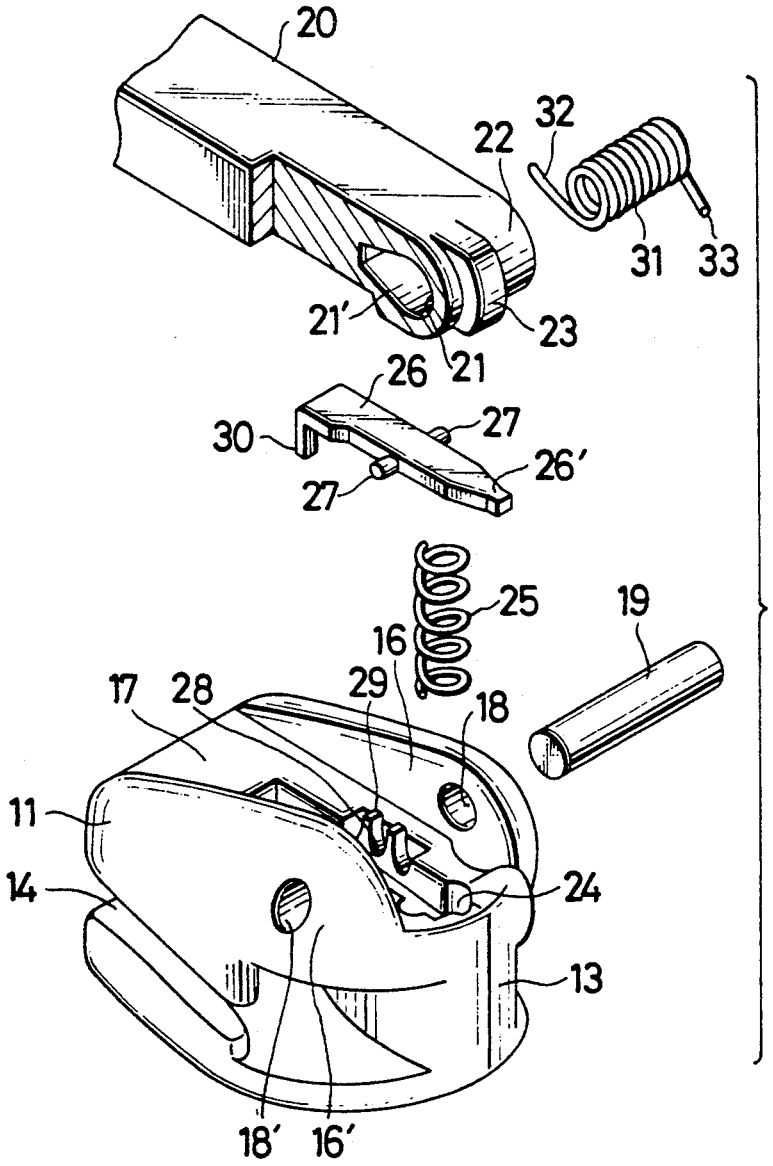
FIG. 5 is an exploded, partly sectional, perspective view of the slider.

The upper wing 11 has raised confronting side flanges 16, 16' defining therebetween a chamber 17 for receiving a pull tab later described and having a transversely aligned openings 18, 18' through which a support pin 19 is inserted as better shown in FIG. 5. The support pin 19, which serves as a pintle of the pull tab 20, is secured in place by clamping the peripheral edges of the openings 18, 18' over the respective ends of the pin 19.

Figure 3:
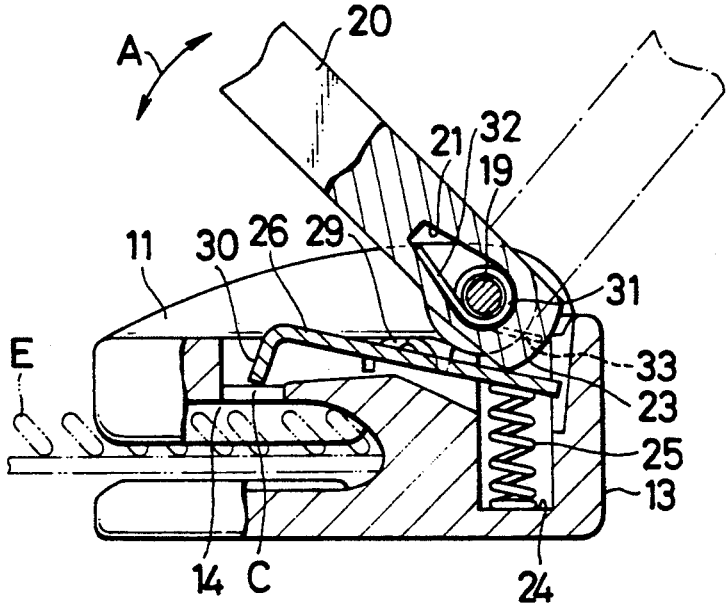
FIG. 3 is a view similar to FIG. 1 but showing the slider in unlocked position.

A pull tab 20 pivotally mounted in the chamber 17 has a cross sectionally oblong transverse aperture 21 at its fulcrum end 22 for receiving the pin 19 about which the pull tab 20 is pivotally supported to rotate in the direction of the arrow A as better shown in FIG. 3. The pull tab 20 is provided with a cam 23 projecting longitudinally from the fulcrum end 22 for purposes hereafter to be described. The oblong aperture 21 is convergent toward the rear end of the pull tab 20 remote from the cam 23 to provide an upwardly slanted bottom wall 21'.

In the neck portion 13 of the slider body is provided a vertically elongated well 24 for accommodating a first resilient means 25 in the form of a compression spring.

A locking member 26 generally rectangular in shape is rockably mounted in the chamber 17 between the pull tab 20 and the upper surface of the upper wing 11, for which purpose the locking member 26 is provided with a pin 27 extending transversely from opposite sides thereof and pivotably received in U-shaped grooves 28, 28' in a pair of laterally spaced lugs 29, 29 formed on the upper surface of the upper wing 11. The locking member 26 is located with one end 26' overlying an upper end portion of the first resilient means 25. A locking prong 30 extends downwardly integrally from the opposite end of the locking member 26 and swings with pivotal movement of the locking member 26 into and out of the guide channel 14 between a first position B shown in FIG. 1 in which the prong 30 engages in between adjacent coupling elements E and a second position C shown in FIG. 3 in which the prong 30 is lifted away from the passage of the coupling elements E in the guide channel 14.

According to an important aspect of the invention, there is provided a second resilient means 31 in the form of a torsion spring wrapping around or enveloping the support pin 19 and received in the oblong aperture 21 of the pull tab. The torsion spring 31 is disposed with one end extension 32 retained in the oblong aperture 21 and laid over the slanted bottom wall 21' thereof and with the opposite end extension 33 drawn out of the aperture 21 and borne against the inner wall of the upper wing flange 16' adjacent to the front end of the slider body, the arrangement being that the second resilient means 31 normally tends to bias the pull tab 20 counterclockwise toward the upper wing 11 as viewed in the drawing.

Figure 4:
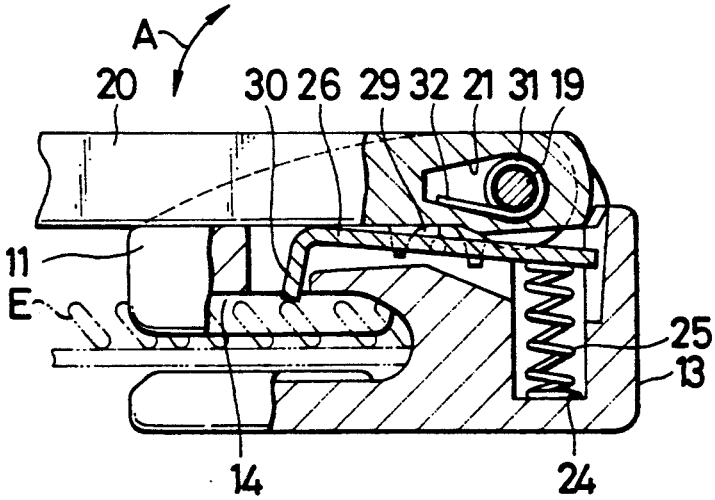
FIG. 4 is a view also similar to FIG. 1 but showing a locking prong stuck on a coupling element.

With this construction of the lockable slider 10 according to the first embodiment of the invention, the slider 10 is locked against movement by flipping the pull tab 20 counterclockwise down flat against the upper wing 11 normally with the aid of spring action of the first resilient means 25 as shown in FIG. 1 in which the locking prong 30 of the locking member 26 engages in between adjacent coupling elements E in the guide channel 14. The slider 30 is unlocked by rotating the pull tab 20 clockwise about the pin 19, when the cam 23 abuts against the one end 26' of the locking member 26, lifting the locking prong 30 out of the guide channel 14 against the tension of the first and second resilient means 25 and 31 as shown in FIG. 3. However, in the event that the locking prong 20 when flipped down fails to enter between adjacent coupling elements E and instead rides over and rests directly on the coupling elements E as shown in FIG. 4, the one end 26' of the locking member 26 tends to be spaced apart from the lower surface of the pull tab 20 due to insufficient spring force of the first resilient mean 25 alone, were it not for the second resilient means 31, with the result that the pull tab 20 somewhat wobbles or rotates idly. This is eliminated by the provision of the second resilient means 31 whose torsional moment compensates for the lack of spring force of the first resilient means 25 and acts upon the pull tab 20 to urge the latter to lie flat against the upper wing 11 of the slider 10 as shown in FIG. 1.

Figure 6:
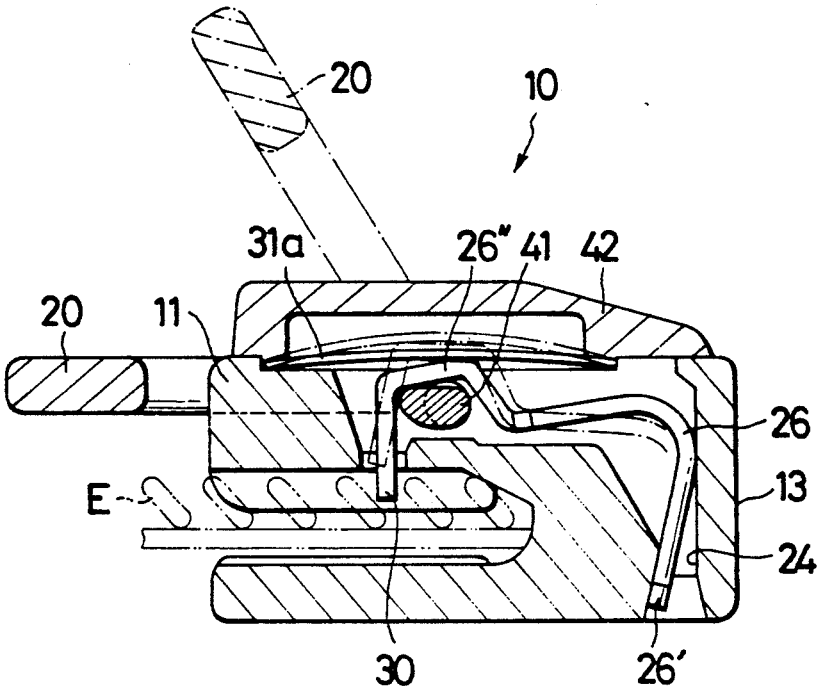
FIG. 6 is a side elevational, partly sectional, view of a slider constructed in accordance with another or second embodiment of the invention.
Figure 7:
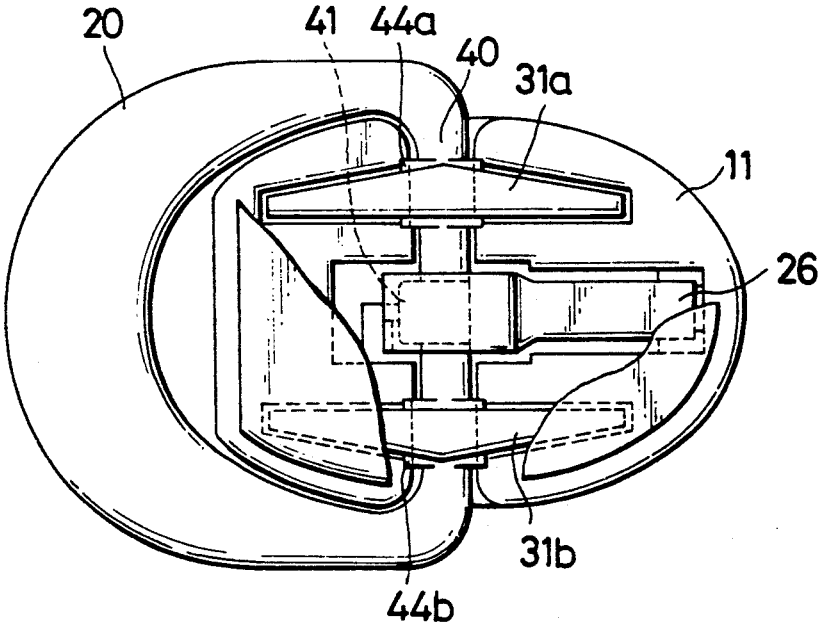
FIG. 7 is a partly sectional, plan view of the same.
Figure 8:
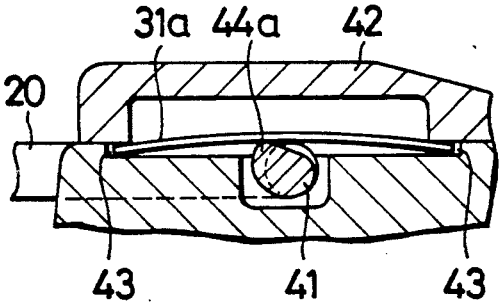
FIG. 8 is a longitudinal cross-sectional view of a portion of the same, showing a pull tab in flipped flat position.
Figure 9:
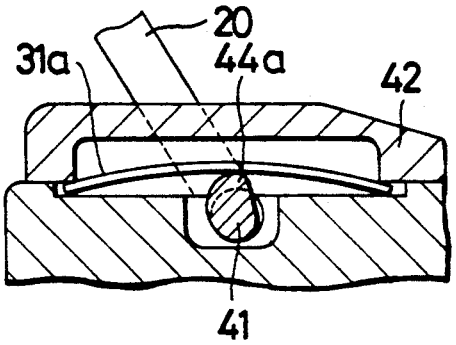
FIG. 9 is a view similar to FIG. 8 but showing the pull tab in lifted position.

FIGS. 6–9 inclusive shows a lockable slider 10 constructed in accordance with a second embodiment of the invention. This slider 10 is of a type somewhat similar to an automatic lock slider disclosed in U.S. Pat. No. 4,391,022 to the same assignee of the present application in that it includes a locking member 26 in the form of a polygonal leaf spring which serves in effect as the first resilient means 25 as well. The locking member 26 has a vertically elongated one end 26' secured in place in the well 24, a generally U-shaped engaging portion 26" and a locking prong 30 extending downwardly therefrom. The pull tab 20 has a pintle 40 about which it is pivotable and a first cam 41 formed centrally on the pintle 40 for engaging the U-shaped portion 26" of the locking member 26. Lifting the pull tab 20 from its solid line position to its phantom line position, as shown in FIG. 6, causes the locking prong 30 to disengage the coupling elements E and ascend away from the guide channel 14 to its phantom line position against the tension of the locking member 26 per se. Releasing or flipping down the pull tab 20 causes the locking prong 30 to descend under the influence of the tension of the locking member 26 and engages normally in between adjascent coupling elements E thereby locking the slider 10 against unintentional movement, in which position the pull tab 20 is held flat against the upper surface of the upper wing 11 as shown in FIG. 6. However, the locking prong 30 is liable to ride over and rest directly against the coupling elements E instead of entering therebetween during its descending movement with the result that the pull tab 20 is held apart from the upper wing 11 and hence tends to idle. This problem is overcome by the provision of a second resilient means 31 in the form of a plain leaf spring according to the second embodiment of the invention. As better shown in FIGS. 6 and 7, the second resilient means 31, which achieves the same function and effect as discussed in connection with the first embodiment, comprises a pair of elongated leaf springs **31*a*, 31*b* accommodated in a casing 42 and laterally spaced on opposite sides of the upper wing 11 and extending in overlying relation to the locking member 26. Both ends of each of the leaf springs 31*a*, 31*b* are loosely fitted in recesses 43 formed between the casing 42 and the upper wing 11 as better shown in FIGS. 8 and 9, so that the leaf springs 31*a*, 31*b* can flex vertically. The pull tab 20 is provided with a pair of downwardly oriented second cams 44*a*, 44*b* extending from opposite ends of its pintle 40 and registering in position with the respective leaf springs 31*a*, 31*b* which normally act upon the respective cams 44*a*, 44*b* so that the pull tab 20 is urged to lie flat against the upper surface of the upper wing 11** of the slider body.

Figure 10:
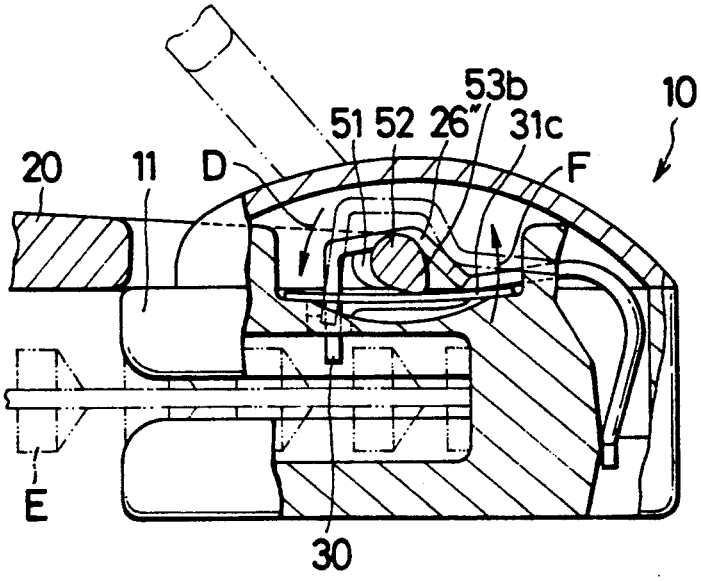
FIG. 10 is a side elevational, partly sectional, view of a slider constructed with a further or third embodiment of the invention.
Figure 11:
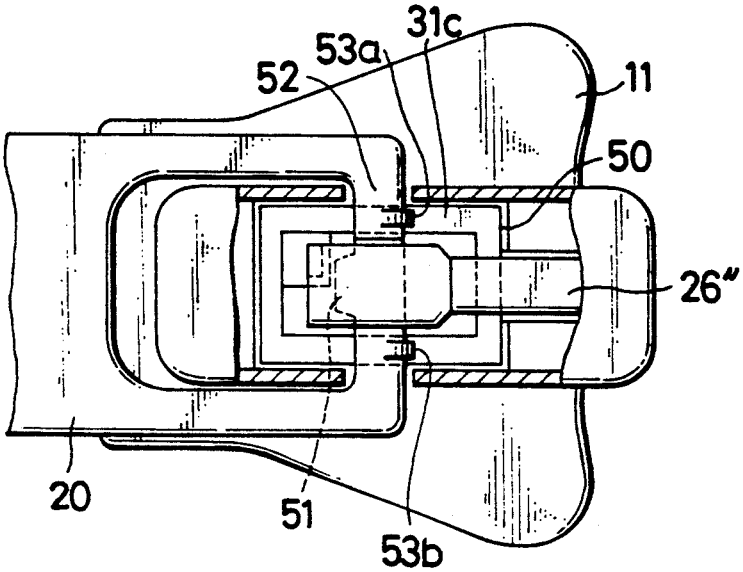
FIG. 11 is a partly sectional, plan view of the same.
Figure 12:
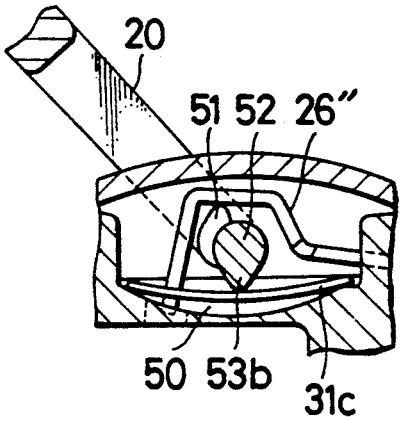
FIG. 12 is a longitudinal cross-sectional view of a portion of the same, showing a pull tab in lifted position.

FIGS. 10–12 inclusive shows a lockable slider 10 according to a third embodiment of the invention in which the second resilient means 31 comprises a leaf spring **31*c* of rectangular frame form as better shown in FIG. 11. The leaf spring 31*c* is flexibly supported in a recessed surface portion 50 of the upper wing 11 and disposed in underlying relation to the locking member 26 in contrast to the second embodiment as better shown in FIG. 12. The pull tab 20 has a first cam 51 formed centrally on a pintle 52 for engaging a U-shaped portion 26" of the locking member 26 which is substantially similar in construction to that which appears in the second embodiment. The first cam 51 is normally urged downwardly by the locking member 26 in the direction of the arrow D as shown in FIG. 10. A pair of upwardly oriented second cams 53*a*, 53*b* extend from opposite ends of the pintle 52 in overlying relation to the leaf spring 31*c* which urges the second cams 53*a*, 53*b* normally upwardly in the direction of the arrow F as shown in FIG. 10**.

When flipping down the pull tab 20 from the unlocked position of the slider 10 shown in FIG. 12 to the locked position in solid line of FIG. 10, the pull tab 20 sometimes fails to lie horizontally flat against the upper wing 11 due to the locking prong 30 riding over and resting directly against the coupling elements E as already described. This problem is solved by the provision of the second resilient means 31 or leaf spring **31*c* which cooperates with the second cams 53*a*, 53*b* of the pull tab 20 in relaining the latter in proper flipped flat position relative to the upper wing 11** of the slider body.

Obviously, various modifications and variations of the present invention are possible in the light of the above teaching. It is therefore to be understood that within the scope of the appended claims the invention may be practiced otherwise than as specifically described.

What is claimed is:

1. A lockable slide fastener slider which comprises:

(a) a slider body including an upper wing and a lower wing joined at one of their respective ends by a neck so as to define therebetween a guide channel for the passage of a pair of rows of coupling elements;

(b) a pull tab having a pintle at one of its ends through which said pull tab is pivotably connected to said upper wing and having a cam means;

(c) a locking member pivotably supported on said slider body and including a locking spring movable into and away from said guide channel;

(d) a first resilient means urging said pull tab to flip down against said upper wing; and (e) a second resilient means operatively associated with said pintle and adapted to urge said pull tab to lie substantially flat against said upper wing in compensation for the lack of resilient forces of said first resilient means, said second resilient means comprising a pair of leaf springs laterally spaced on opposite sides of said upper wing and extending in overlying relation to said locking member.

2. A lockable slide fastener slider which comprises:

(a) a slider body including an upper wing and a lower wing joined at one of their respective ends by a neck so as to define therebetween a guide channel for the passage of a pair of rows of coupling elements;

(b) a pull tab having a pintle at one of its ends through which said pull tab is pivotably connected to said upper wing and having a cam means;

(c) a locking member pivotably supported on said slider body and including a locking spring movable into and away from said guide channel;

(d) a first resilient means urging said pull tab to flip down against said upper wing; and (e) a second resilient means operatively associated with said pintle and adapted to urge said pull tab to lie substantially flat against said upper wing in compensation for the lack of resilient forces of said first resilient means, said second resilient means comprising a leaf spring of rectangular frame form disposed in underlying relation to said locking member.

* * * * *